United States Patent [19]

Parry et al.

[11] Patent Number: 4,601,156

[45] **Date of Patent: * Jul. 22, 1986**

[54] APPARATUS FOR BUNCHING, TRIMMING, AND BANDING VEGETABLES

[75] Inventors: Curtis L. Parry; Gary R. Cushing, both of Salinas, Calif.

[73] Assignee: Salinas Valley Engineering & Mfg., Inc., Salinas, Calif.

[ * ] Notice: The portion of the term of this patent subsequent to Sep. 11, 2001 has been disclaimed.

[21] Appl. No.: 635,918

[22] Filed: Jul. 30, 1984

Related U.S. Application Data

[62] Division of Ser. No. 380,515, May 21, 1982, Pat. No. 4,470,241.

[51] Int. Cl.[4] ..... B65B 13/02

[52] U.S. Cl. ..... 53/399; 53/435; 53/515; 53/585

[58] Field of Search ..... 53/515, 585, 556, 291, 53/292, 390, 391, 294, 399, 435, 592; 100/9

[56] References Cited

U.S. PATENT DOCUMENTS

| | | | |
|---|---|---|---|
| 2,518,757 | 8/1950 | Coley | 53/515 |
| 2,601,547 | 6/1952 | Minock | 53/585 |
| 2,834,784 | 7/1958 | Dunning | 53/556 |
| 3,393,633 | 7/1968 | Hoffman | 53/390 X |
| 3,961,459 | 6/1976 | Worske | 53/556 |
| 3,974,762 | 8/1976 | Kita | 53/585 X |
| 4,095,391 | 6/1978 | Anguiano | 53/515 |
| 4,401,020 | 8/1983 | Brux | 53/515 |

FOREIGN PATENT DOCUMENTS

| | | | |
|---|---|---|---|
| 2219490 | 10/1973 | Fed. Rep. of Germany | 53/585 |

*Primary Examiner*—John Sipos

*Attorney, Agent, or Firm*—Gerald L. Moore

[57] ABSTRACT

Apparatus for bunching, trimming and banding vegetables and the like comprising a plurality of arms (20) each having fixed thereto an upstanding finger (32) means (22) supporting the arms for movement in a common plane toward and away from a common area, an actuator (28) for moving the arms in unison and a top plate (16) forming a center opening (18) centered about the common area whereby the arms can be moved to the center, an elastic band (34) placed over the upstanding fingers, the arms actuated away from the common area and a bunch of vegetables inserted so that movement of the arms back toward the common area will allow the elastic band to hold the bunch. A truncated cone shaped hollow guide (37) positioned beneath the arms will guide the vegetables together for bunching.

2 Claims, 16 Drawing Figures

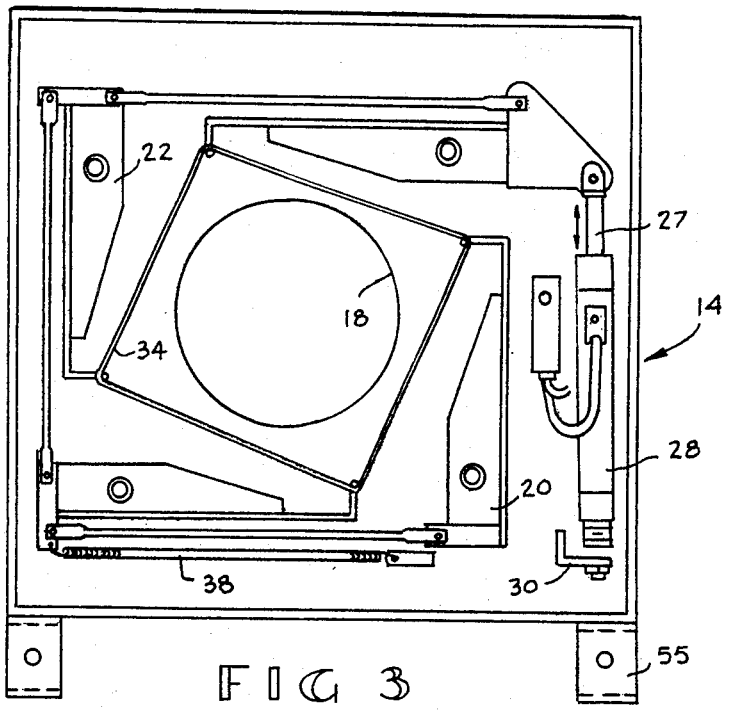
FIG 3
FIG 4
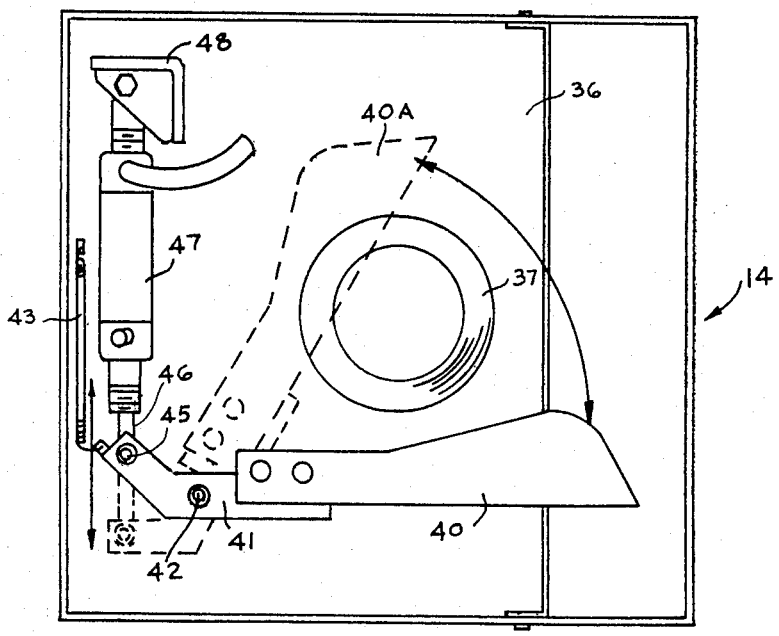

FIG 5
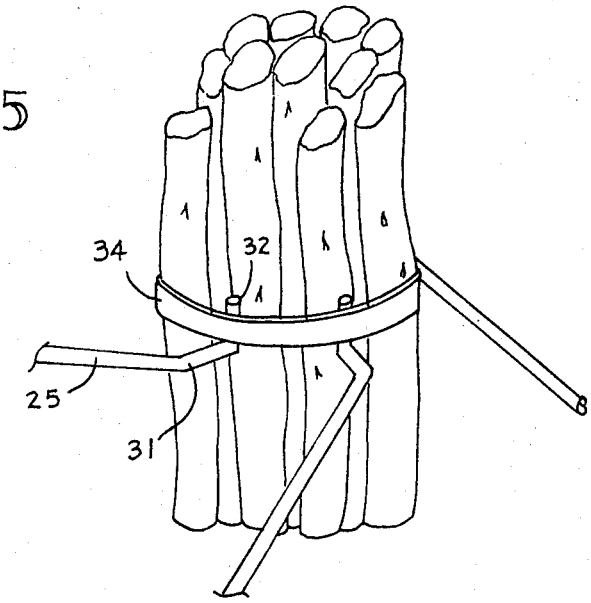
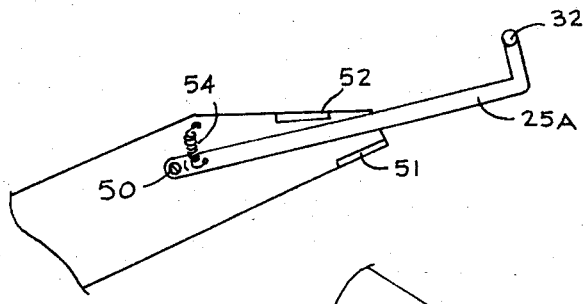
FIG 6
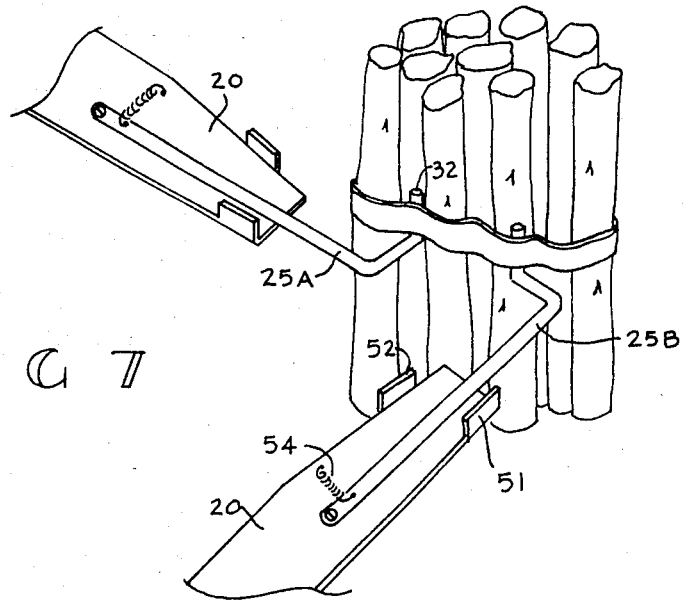
FIG 7

APPARATUS FOR BUNCHING, TRIMMING, AND BANDING VEGETABLES

This is a division of application Ser. No. 380,515, filed May 21, 1982, now U.S. Pat. No. 4,470,241.

FIELD OF THE INVENTION

This invention relates to apparatus for use with vegetables having stalks such as broccoli and celery wherein bunches can be inserted for simultaneous banding and trimming, either in the field or in a packing shed. The device can also be used to band other articles such as newspapers, flowers, and the like.

BACKGROUND OF THE INVENTION

Many vegetables, such as broccoli and celery are bunched and tied for shipment to the market in shipping cartons. In the past, broccoli has been cut and transported to a packing shed for bunching, generally the bunches have been tied with wire and more recently there is used a plastic collar into which the broccoli stalks are inserted. In either instance the packing process is expensive and time consuming.

Apparatus for bunching and binding vegetables has been used previously in a packing shed environment. Normally the vegetables are cut and transported from the field to a shed wherein stationary equipment is utilized to bunch, band, and trim the stalks. Since most vegetables are cooled as soon as possible after harvesting for transport to the market, it is advantageous to reduce the time differential between harvesting and cooling. It is also advantageous to reduce the handling of the vegetables both from the standpoint of reducing any bruising as well as reducing the cost of harvesting. After bunching, trimming, and banding in the field, the vegetables can be moved immediately to the cooler.

It is one purpose of the present invention to permit the bunching, trimming, and banding of vegetables in the field as they are harvested and with apparatus that is compact and easily transported.

The bunching, trimming, and banding apparatus is compact and efficient as well as being simple to operate and maintain. Additionally, by limiting the vertical height, the apparatus is easily adaptable to a packing shed environment wherein a plurality of the devices are placed on a conveyor for preparing vegetables for shipment.

It is another purpose of the present invention to provide a conveyor-supported multiple station bunching, trimming, and banding apparatus for use in a packing shed.

Still a further purpose of the present invention is to provide a banding apparatus suitable for banding other articles such as newspapers, flowers, and the like.

DESCRIPTION OF THE DRAWINGS

FIG. 3 is a cross-sectional view along the line 3—3 of FIG. 2;

FIG. 4 is a cross-sectional view along the line 4—4 of FIG. 2;

FIG. 5 is a perspective view showing the arms actuated into contact with vegetable stalks and the elastic band in place to hold the bunch;

FIG. 6 is a top view of a second embodiment of the arms;

FIG. 7 shows the second embodiment arms in position to deposit the elastic band on a bunch of vegetable stalks;

SUMMARY OF THE INVENTION

A compact apparatus for bunching, trimming, and banding vegetables and other elongated products. The apparatus includes a plurality of arms supported to pivot in a horizontal plane. An actuator moves the arms in unison away from a central axis to stretch an elastic band over the previously juxtaposed arm tips. After insertion of the articles the arms are moved back together to allow the band to contact and hold the bunch. With release of the arms a knife is actuated in a horizontal plane to cut off the article butts below the band. A hollow cone guide positioned between the band and the knife bunches the articles tightly for banding and holds the articles while the knife cuts therethrough. Other embodiments of the invention include an interchangeable ring guide to size the bunches properly as they are placed in the apparatus. Also a plurality of the devices placed on a conveyor and actuated at various stations provide an assembly line type of packing shed operation.

DESCRIPTION OF THE INVENTION

Figure 2:
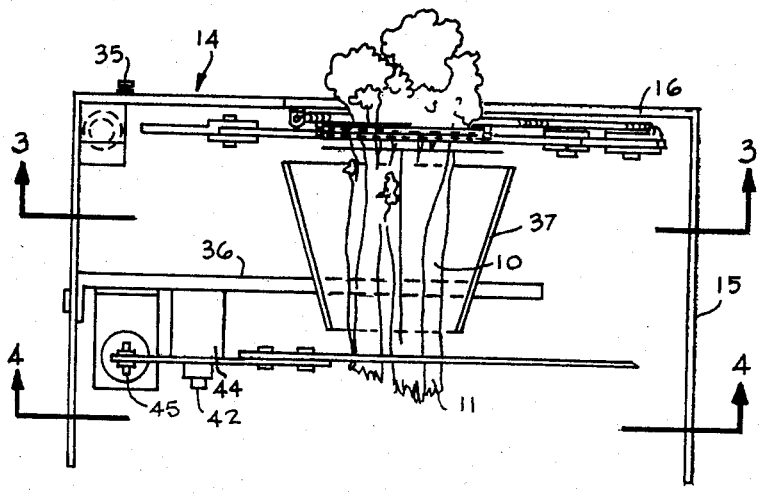
FIG. 2 is a cross-sectional view along the line 2—2 of FIG. 1.

In FIG. 2 is shown a vegetable bunch 10 to be tied and the butt 11 trimmed. This vegetable bunch can be such vegetables such as broccoli, celery, and the like. For this purpose there is provided the apparatus 14 comprising a housing made up of side walls 15 and a top plate 16. The top plate includes an opening 18 centered about a vertical axis (not shown) or common area in which the vegetables are placed.

Supported for pivotal motion towards and away from the common area coaxial with the opening 18, are a plurality of arms 20 (FIG. 1) fixed to the top plate 16 by bolts or pins 22. Each arm is supported by a separate plate 24 and includes an intermediate section 25 extending toward the common axis with attached fingers 32 formed by bending the ends of the arms at or close to right angles toward the center position and then upward. The four arms are serially connected by linkages 26 which are pivotally attached thereto with one arm being pivotally attached to a rod 27 extending from an actuator in the form of an air piston 28 fixed to the top wall 16 by a bracket 30. When fluid in the form of pressured air is supplied to the air piston from a source (not shown), the air piston moves the rod 27 inward to pivot each of the arms in the clockwise direction outward to the position shown in FIG. 3.

Figure 1:
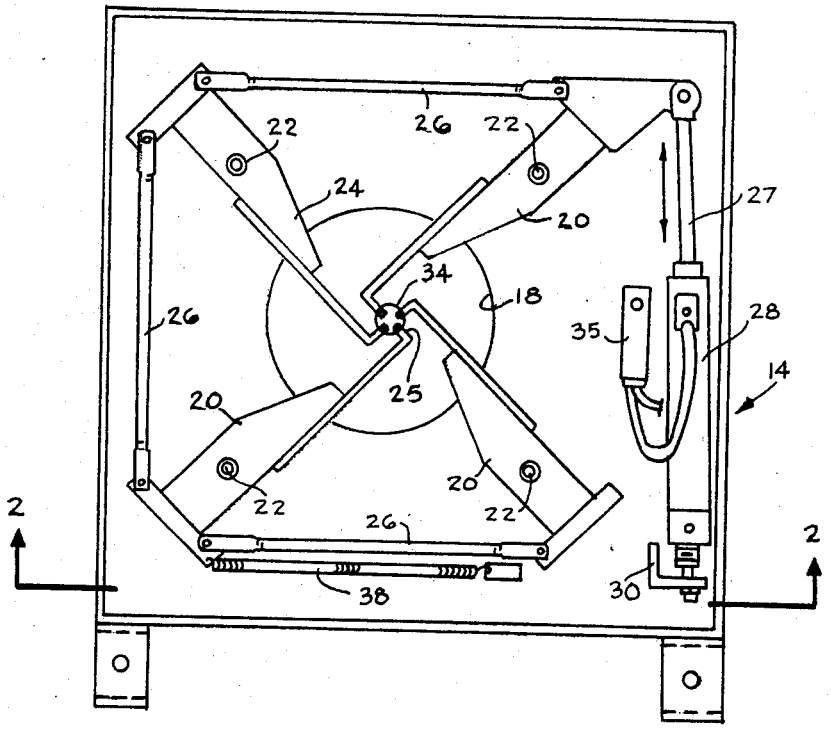
FIG. 1 is a top view of a bunching, banding, and trimming apparatus embodying the present invention.

To hold an elastic band 34, the end segment 25 of each arm is bent vertically upward to form the finger 32 (FIG. 5). With the arms moved toward the center as shown in FIG. 1, an elastic band 34 can be placed over the juxtaposed and upwardly extending fingers. Thereafter by actuation of a switch 35 (FIG. 2) air is supplied to the air cylinder 28 to pivot the arms apart to the positions shown in FIG. 3 such that the band 34 is stretched to a position extending clear of the opening 18 in the top plate. Thereafter the vegetable bunch 10 can be inserted downward through the opening 18 for banding.

The opening 18 serves to guide and center the articles. If not reasonably centered and grouped together, more damage or bruising of the stalks can occur as the arms first contacting the bunch tend to push the stalks toward the common area until the opposing arms contact the bunch. It is also advantageous to guide the lower ends of the stalks and to hold them closely together while the band is seated and for this purpose there is supported on a bracket 36 a guide 37 (FIG. 2) in the form of a hollow truncated cone. This guide acts as a funnel to center position the vegetable stalks and force them together sufficiently for effective banding and trimming. Thereafter by actuation of the switch 35 the air is released from the air cylinder 28 (FIG. 1) allowing a spring 38 and the elastic band to pivot the arms back toward the center position. The arms will move until the fingers 32 contact the vegetable stalks.

Positioned beneath the guide 37 is a knife 40 (FIGS. 2 and 4) fixed to a bracket 41 pivotally supported by a pin 42 attached to a pedestal 44 mounted on the center tray 36 of the apparatus. The end of the bracket 41 opposite the knife is fixed by a pin 45 to a shaft 46 extending to an air cylinder 47. Also a spring 43 extends from the bracket 41 to the center tray to return the knife to the solid line position shown in FIG. 4 when the acuator is deenergized. The opposite end of the air cylinder is supported on a bracket 48 fixed to the center tray of the apparatus. With actuation of the switch 35 to move the arms 20 from the position shown in FIG. 3, the band is allowed to tighten about the vegetable stalks at the same time the knife 40 is moved also from the solid line position to the dotted line position shown in FIG. 4. This action swings the arm in the horizontal plane to cut off the butt or root portions of the stalks as the banding is effected. The guide 37 holds the bunch as the knife severs the lower end from the stalks. By utilizing planar actuated arms 20, space is allowed for the guide and the actuating mechanism for the arms.

With movement of the arms 25 into contact with the stalks 10, the band 34 is permitted to contact and hold the bunch. After the knife is translated to cut the butt from the stalks the vegetable bunch is lifted vertically upward out of the apparatus. The band 34 will slip from the upwardly extending tips 32 of the arms to remain around the bunch since the bunch is of a sufficiently large diameter to maintain the band thereon as shown in FIG. 5. Afterward another band is put on, the switch is pulled up and the fingers spread the band, while the spring returns the knife to the pre-cutting position. Thus, the bunch is formed, banded, and the butt trimmed in one quick and efficient motion.

A second embodiment of the invention is illustrated in FIGS. 6 and 7. As the arms 25 in the first embodiment move inward they will automatically center the bunch since the first arm to contact the bunch will push it until it contacts the diagonally opposed arm. However, when the bunches are contacted by two diagonally opposed arms, the third and fourth arms cannot move the bunch sidewise and such action can leave the fourth arm not yet in contact with the bunch. When such happens, it is more difficult to lift the bunch from the machine because of the firm contact between the elastic band the fourth arm.

In accordance with this second embodiment of the invention the arm segments 25A are each pivotally connected to the supporting plate 20 by a pin or bolt 50. The arm segments are permitted to rotate through a small angle between a stop 51 and a stop 52 on the plate. A spring 54 extending between the plate and the arms hold the arm segment normally against the stop 52. As illustrated in FIG. 7, when a first arm 25B contacts the stalk, the spring 54 will be extended to allow further pivoting of the attached plate 20. Such pivoting allows continued movement of the other plates 20 and supported arms 25A even though the one arm has contacted the vegetable bunch. In the usual instance, this action will permit all the fingers 32 to contact the bunch. With all of the fingers 32 in contact with the bunch the elastic band also closely contacts the bunch and exerts less frictional engagement with the fingers. This action allows the bunch to be removed more easily from the apparatus because the fingers are abutting the vegetable bunch thereby lessening the chance that the elastic band will be pulled from the bunch as it is removed from the apparatus.

Normally the apparatus 14 just described will be used in the field supported by some type of conveyance and will be attached by brackets 55 such that the top plate 16 is approximately waist high and horizontal. In this manner the cut vegetables can be placed within reach of the operator who will then place them vertically through the top opening 18 for bunching in the manner previously described.

Figure 8:
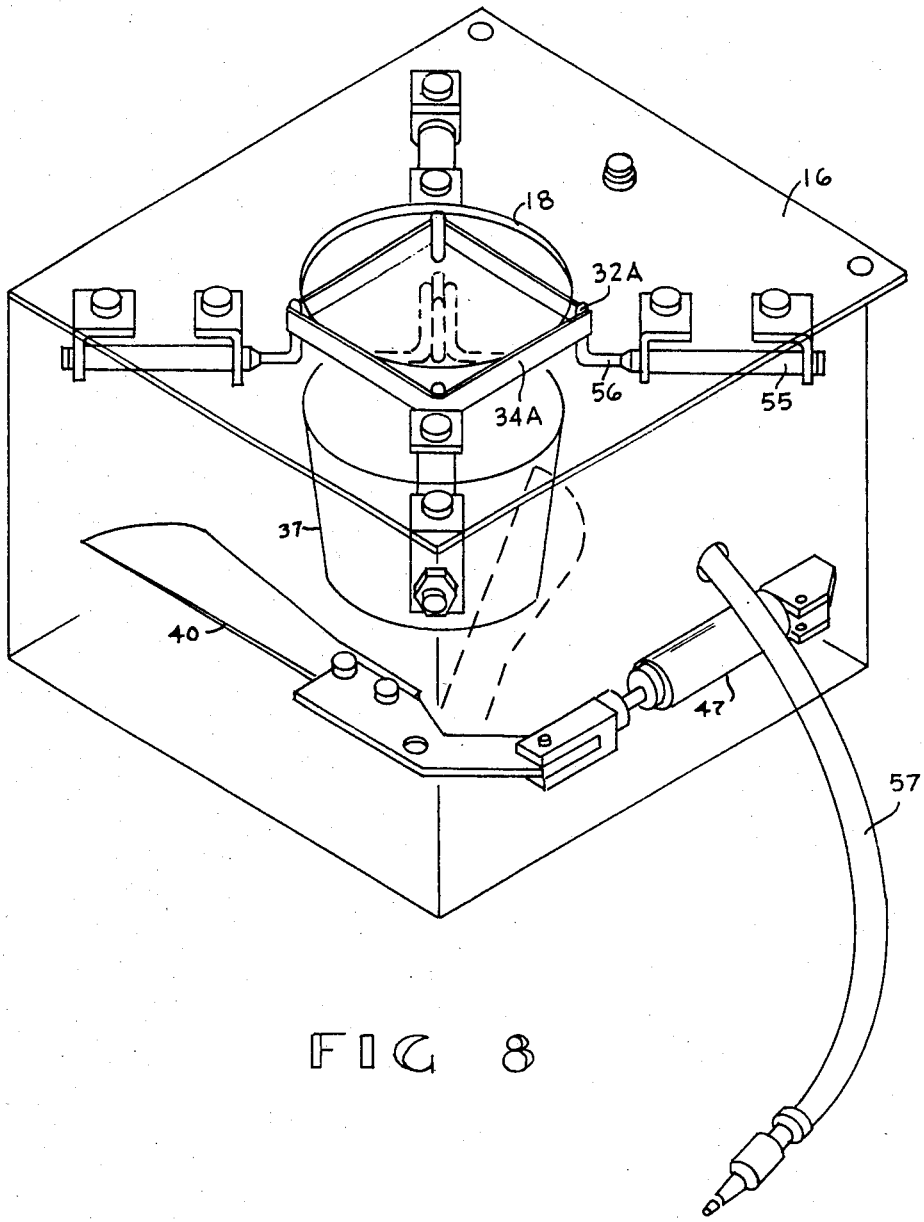
FIG. 8 shows a third embodiment of the invention utilizing multiple actuators for moving the banding arms.

A further refinement of the invention is illustrated in FIG. 8. As described before, it is advantageous for all the fingers to be in contact with the bunch to reduce the frictional engagement between the fingers and the elastic band and make removal of the bunch and band from the apparatus easier. Shown in FIG. 8 the bunch (not shown) is inserted through the opening 18 in the top plate 16 (shown in outline form) after the fingers 32A are retracted to stretch the elastic band 34A as previously explained. To actuate the fingers, a separate actuator 55 is provided for each arm 56. Each actuator is connected to an air hose 57 in the manner shown in FIG. 15. Thus, each arm 56 will be moved outward as explained before, but when the air pressure on the actuator is relieved, each arm will move toward the common point until the attached finger 32A contacts the bunch. Since each finger can move independently all fingers will touch the bunch and thereby assure that the elastic band will contact the bunch on all sides for easy removal. While not shown, this embodiment also utilizes the guide and knife mechanisms as described before.

Figure 9:
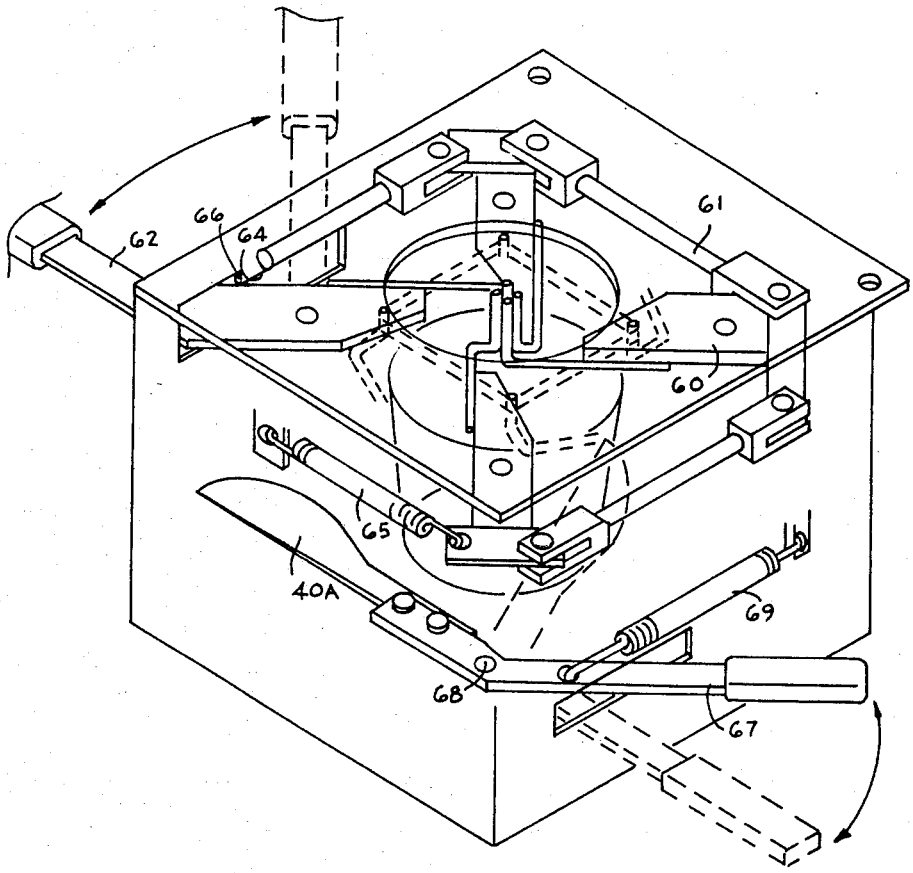
FIG. 9 is a manually operated banding and trimming apparatus.

In FIG. 9 is shown a manually operated apparatus for bunching, banding, and trimming articles. The arms 60 are configured as described in FIG. 1. Linkages 61 connect the adjacent arms and function as previously described. For actuating the arms to move the fingers 32B outward from the common area, a lever 62 is connected to one arm. The lever extends through a slot 64 in the side wall 15 of the housing. By actuating the lever in the counterclockwise direction, the arms are pivoted outward from the center against the force of the elastic band and a spring 65. The lever can be locked behind a stop 66 formed in the slot edge. The bunch is placed through the center opening 18 of the top wall 16 and within the band 34 as described before. By disengaging the lever from the stop 66 the fingers 32 are pivoted toward the center by the elastic band and the spring 65 to set the band in place. Thereafter a second lever 67 is pulled out from the housing by pivoting it about a supporting pin 68 to swing the blade 40A through the bunch and cut the butts therefrom. A spring 69 returns the handle to the original position. Spring 65 returns the fingers to the original position.

Figure 10:
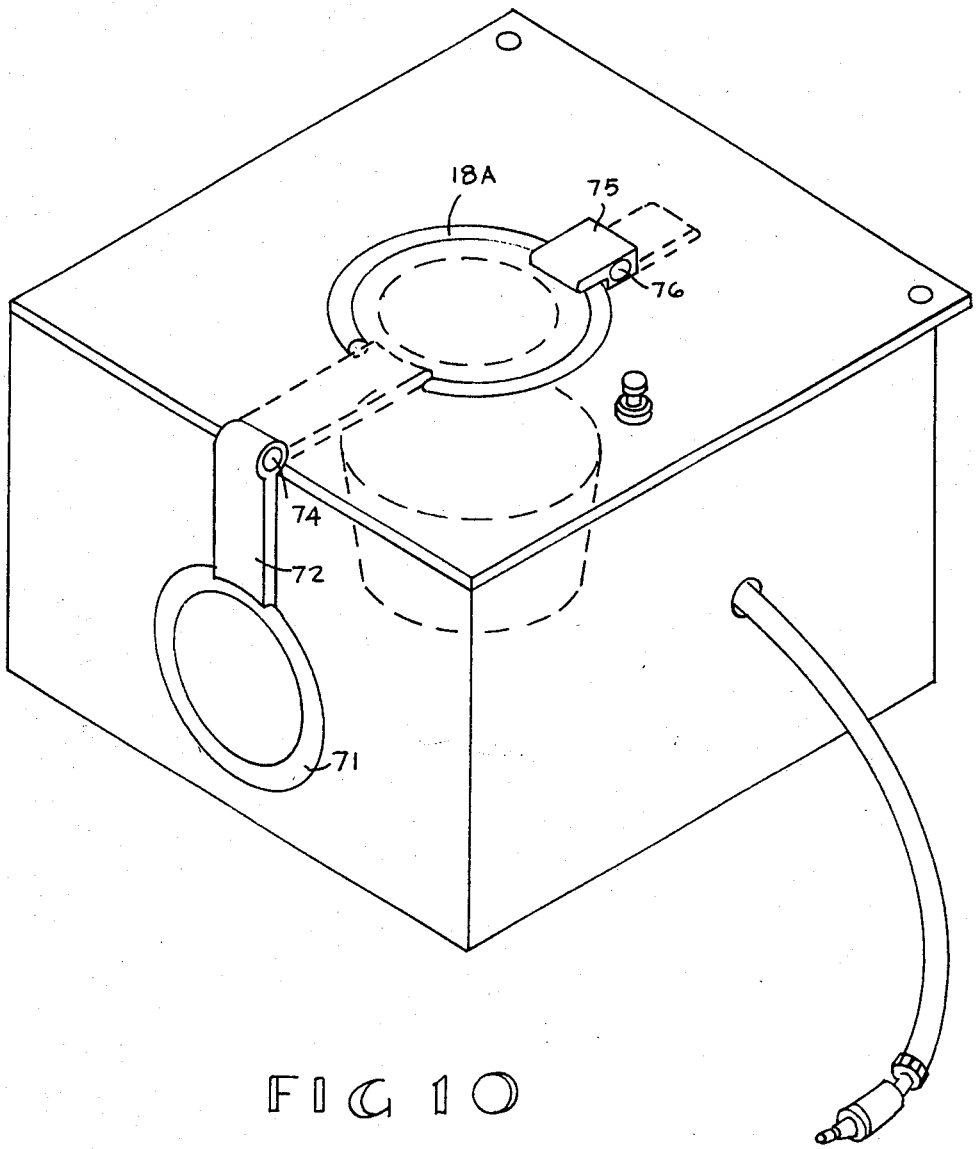
FIG. 10 shows the movable ring to allow banding of different sized bunches.

In FIG. 10 is shown a further embodiment of the invention. With some products and especially broccoli which is packed into shipping cases (not shown) after banding and trimming, two sizes of bunches are most frequently banded. The larger size allows the packing of fourteen bunches per case and a smaller size allows eighteen bunches to be packed into a case. For the larger bunch, the hole 18 as previously described as being formed in the top plate 16 of the apparatus is properly sized. However, for banding smaller bunches, there is supplied the ring 71 shown in FIG. 10. The ring is supported on a bracket 72 pivotally mounted on the housing by a pin 74 fixed thereto. When the ring is pivoted into position over the opening 18, the smaller opening 71A therein determines the size of the bunch to be placed for banding. Otherwise the opening 18A in the ring 74 placed around the opening 18 governs the bunch size. It is important to be able to change the opening size quickly and easily because at times the vegetable being harvested may be too large to fit through the smaller opening 71A and an immediate adjustment must be made. A latch 75 pivotally mounted on a pin 76 holds the ring 71 in position on the top plate 16 of the housing. The round cross sections of the ring also prevents damage to the vegetables being bunched.

Figure 15:
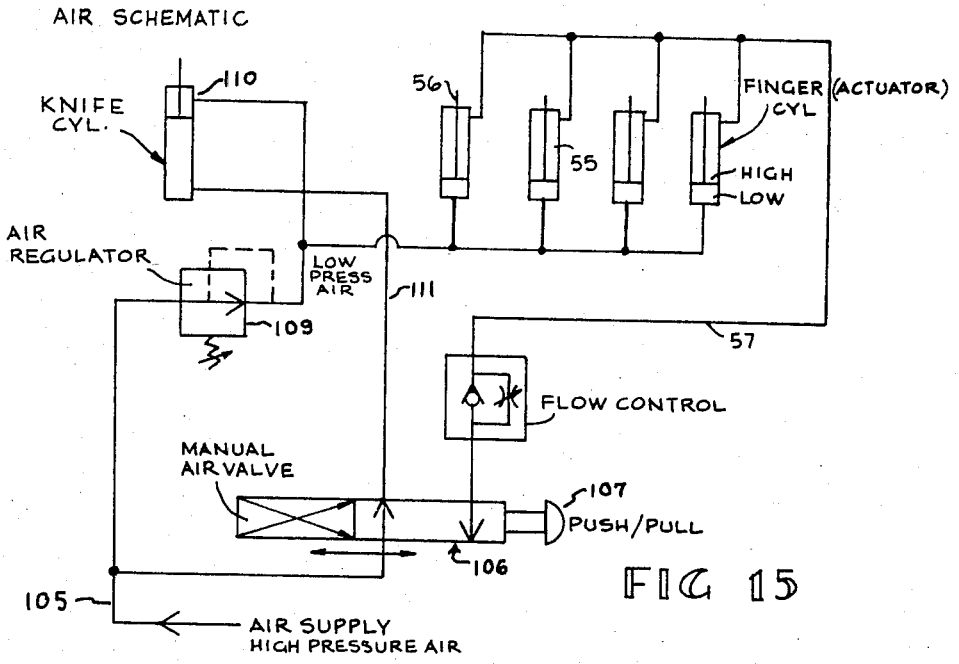
FIGS. 15 and 16 show the air control systems in schematic form.
Figure 16:
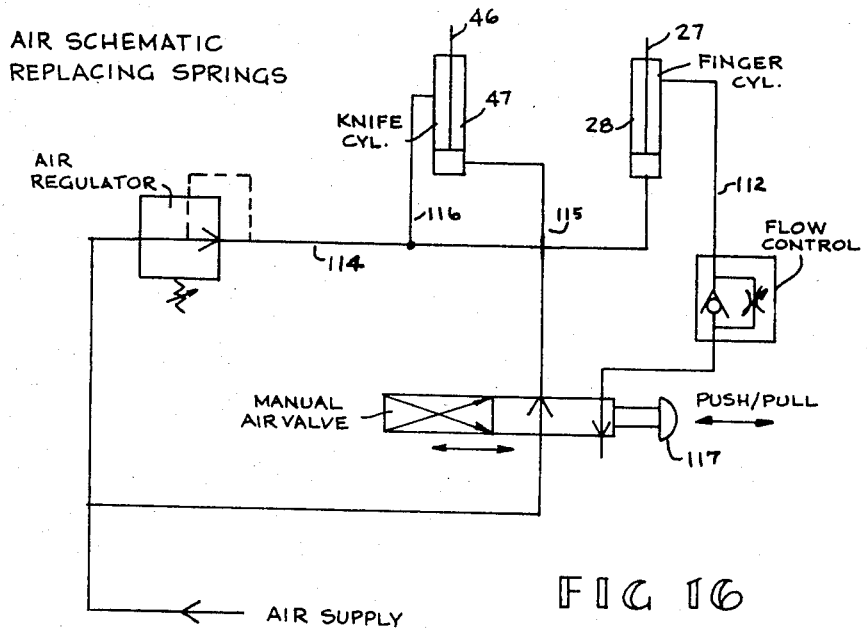

The controls for air actuated devices are shown in FIGS. 15 and 16. In FIG. 15 the control is designed to regulate a device having an actuator for each arm. In FIG. 16 is shown a control wherein a single actuator is used to move all the arms in unison. The supply air is fed through a line 105 to an air valve 106 and an air regulator 109. Thus, low pressure air is supplied to one side of each cylinder to return the cylinder to the rest position and high pressure air is supplied to actuate the cylinder. The high pressure air exerts sufficient force to overcome the force of the low pressure air. The flow control limits the speed at which the cylinders are actuated.

Actuation occurs with the pulling or pushing of the knob 107 which is positioned on the top plate of the device. High pressure air is passed through the line 111 to the cylinder 110 while the finger cylinders are vented. Thereafter the finger cylinders are pressured with high pressure air and the knife cylinder is vented to allow the knife to return to the rest position.

In FIG. 16, high pressure air is supplied to the single finger cylinder 28 and low pressure air is supplied through the line 114. The knife cylinder is supplied high pressure air through the line 115 and low pressure air through the line 116 connecting with the line 114. A push pull knob 117 is provided to control actuation of the cylinders. The operation is the same as described in FIG. 15.

At times it is advantageous to bunch articles in an assembly line procedure. Shown in FIGS. 11 through 14 is an apparatus for receiving the vegetables or other articles from a conveyor 77. The vegetables fall from the conveyor down an incline 78 onto a platform 79 extending parallel to a bunching apparatus 80. Operators stand on a walkway 81 positioned on the opposite side of bunching apparatus where they can reach across and grasp the vegetables. Leaves and bad products are picked from the vegetables and passed through the chute 82 to a carry-out conveyor 84. A plow 85 positioned on top of the conveyor 77 moves back and forth on the conveyor pushing the product off so it falls down the incline 78 and fills the tray 79, the drive means for the plow comprises a motor (not shown) acting through the drive chain 85A.

Figure 11:
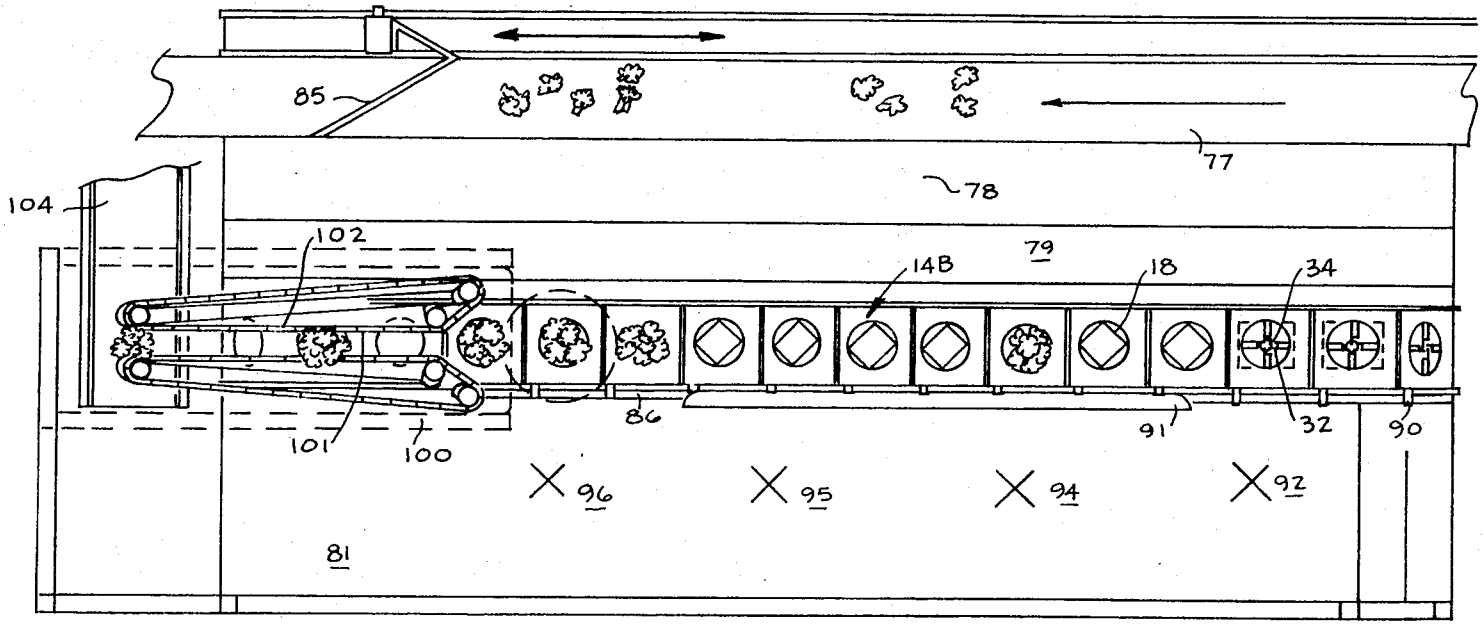
FIG. 11 is a top view of a conveyor mounted banding and trimming apparatus.
Figure 12:
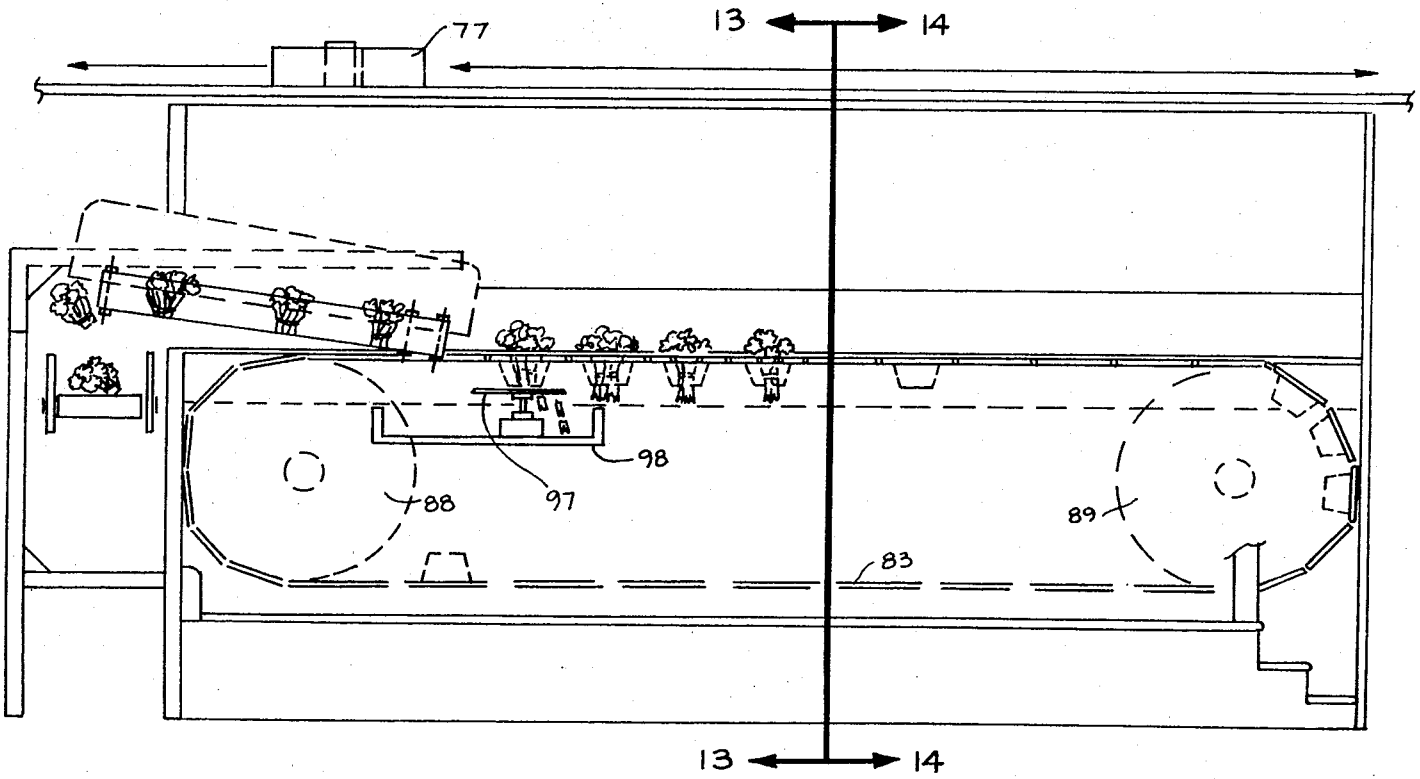
FIG. 12 is a side view of the apparatus shown in FIG. 11.
Figure 14:
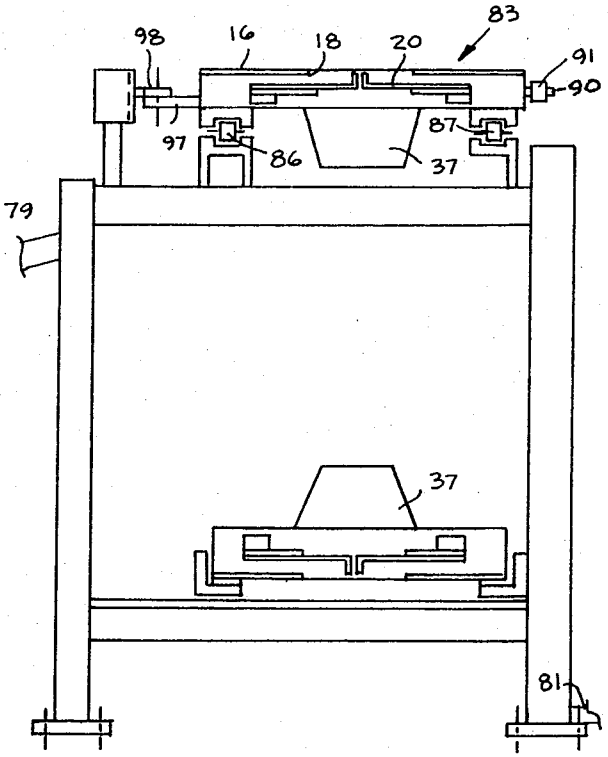
FIG. 14 is a cross-sectional view along the line 14—14 of FIG. 12.
Figure 13:
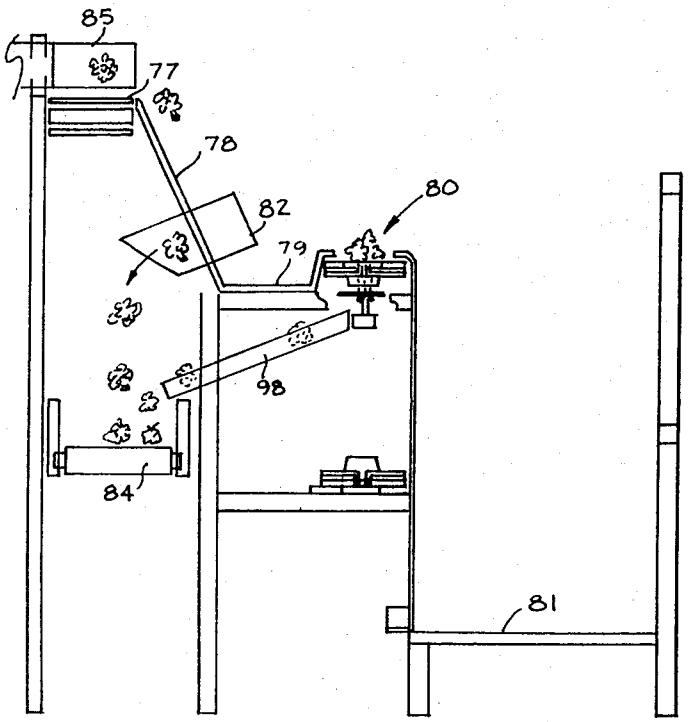
FIG. 13 is a cross-sectional view along the line 13—13 of FIG. 12.

Because the apparatus 14 previously described is compact and has a reduced vertical height, it is particularly adaptable for attachment to a conveyor 83 (FIG. 11). Accordingly, a plurality of endless chains 86 and 87 supported around spaced sprockets 88 and 89 positioned at opposite ends of the walkway 81. Each apparatus **14*b* functions in substantially the same manner as the manual apparatus described with respect to FIG. 9 except there is no knife. A lever 90 actuates the arms and is in turn actuated by a stationary cam 91 at station 92 adjacent the conveyor 83 after placement of the elastic band 34 around the arm fingers 32. At stations 94, 95, and 96 the vegetables are taken from the tray 79 and placed in bunches in the apparatus. At station 96 the lever 90 is released to allow the arms to set the elastic band around the bunch. As apparatus passes last station, butts are trimmed by passing over spinning saw blade 97—butts fall into chute 98 and are deposited on belt 84**.

To remove the bunches from the apparatus, an off-loading conveyor or extractor means 100 comprising a pair of side-by-side endless belts 101 and 102 is positioned above the conveyor 83 to grip the tops of the bunches and lift them out of the openings 18. Thereafter these bunches are deposited on a conveyor belt 104 for transport to a packing station (not shown).

Thus, it can be seen that several embodiments of the invention are described for bunching, banding, and trimming articles. While each embodiment is different, each makes use of the unique qualities of the invention.

We claim:

1. Apparatus for bunching into a bunch and banding with an elastic band articles such as vegetables having a head and stalk, comprising:

a top plate having an opening therein of sufficient size to allow passage of a plurality of parallel positioned stalks forming a bunch of vegetables of predetermined size but small enough to not allow passage of the heads of said vegetable bunch;

a plurality of arms each having fixed thereto a finger;

means supporting said arms below and immediately adjacent said top plate for movement in a single plane to move the finger towards and away from a common area centered on said opening in said top plate and with the tips extending vertically upward and positioned adjacent each other when moved together to receive and hold an elastic band;

a first actuator for moving said arms towards and away from said common area to allow placing an elastic band onto said fingers and thereafter with movement of said finger away from said common area to stretch said elastic band sufficiently to allow passage of said vegetable stalks through said stretched elastic band;

said opening in said top plate being sized to guide the vegetable stalks between said fingers when the finger are moved away from the common area to stretch an elastic band placed around said fingers such that movement of said arms back towards the common area will deposit said elastic band about the stalks to band the bunch;

a hollow guide in the form of a truncated cone positioned beneath said arms and centered about said common area with the larger opening facing upward to receive and tightly bunch said vegetable stalks as they are pushed through said hollow guide until the vegetable heads contact said top plate;

said top plate and the bottom of said hollow guide being positioned apart a distance less than the ultimate desired length of the stalks of said vegetables;

a knife mounted beneath said hollow guide;

means to cause relative movement between said knife and said guide to move said knife through said stalks and cut them to a desired length whereby said banded and sized vegetable bunch can thereafter be removed by relative movement between the stalks and said fingers to disengage said band from said fingers.

2. The method of preparing a vegetable bunch having stalks and heads, such as broccoli, in an apparatus having top plate with a center opening, a plurality of arms with fingers movable to receive and stretch an elastic band below said top plate, a hollow truncated cone-shaped guide below said fingers with the larger opening of the cone facing upwards and a knife below said cone all positioned along a center axis passing through said top plate center opening, the steps of:

placing an elastic band on said fingers and moving said plurality of arms apart to stretch said band about said center opening, gathering vegetables and inserting them stalk first through said center opening; said stretched elastic band, and said guide until the stalks are sufficiently numerous to be squeezed together a predetermined amount by said truncated conical guide and, a sufficient distance such that all heads contact said top plate;

actuating said plurality of arms to relax said elastic band onto said stalks, actuating said knife to cut the stalk bottoms an equal length at a plane close to said guide while maintaining said vegetable heads in contact with said top plate; and moving said vegetables bunch axially to disengage said elastic band from said fingers and remove said bunch with elastic band from said apparatus.

* * * * *